US011462875B2

(12) United States Patent
Schuster et al.

(10) Patent No.: US 11,462,875 B2
(45) Date of Patent: Oct. 4, 2022

(54) BARREL CRIMP RETENTION FEATURE FOR CONNECTOR WITH BRAIDED WIRE

(71) Applicant: APTIV TECHNOLOGIES LIMITED, St. Michael (BB)

(72) Inventors: James P. Schuster, Vienna, OH (US); William J. Palm, Warren, OH (US); Michael Messuri, Canfield, OH (US); Jared Bilas, North Bloomfield, OH (US); Dominic A. Messuri, Canfield, OH (US); Leslie Jones, Garrettsville, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/123,840

(22) Filed: Dec. 16, 2020

(65) Prior Publication Data

US 2022/0190538 A1 Jun. 16, 2022

(51) Int. Cl.

| | |
|---|---|
| ***H01R 43/048*** | (2006.01) |
| ***H01B 7/22*** | (2006.01) |
| ***H01R 24/56*** | (2011.01) |

(52) U.S. Cl.

CPC ..... *H01R 43/048* (2013.01); *H01B 7/228* (2013.01); *H01R 24/568* (2013.01); *H01R 2201/26* (2013.01)

(58) Field of Classification Search

CPC ..... H01R 43/048; H01R 24/568; H01R 2201/26; H01B 7/228

USPC ..... 439/153

See application file for complete search history.

(56) References Cited

U.S. PATENT DOCUMENTS

| | | | | |
|---|---|---|---|---|
| 4,719,697 | A | 1/1988 | Schwartzman et al. | |
| 6,692,299 | B1 * | 2/2004 | Stockmaster | H01R 9/0518 439/578 |
| 7,819,694 | B2 * | 10/2010 | Miyashita | H01R 9/05 439/585 |
| 9,660,355 | B2 * | 5/2017 | Kato | H01R 13/6591 |
| 9,692,146 | B2 * | 6/2017 | Justi | H01R 13/6583 |
| 9,793,692 | B1 * | 10/2017 | Pogash | H01B 17/583 |

(Continued)

FOREIGN PATENT DOCUMENTS

EP 3220483 A1 9/2017

OTHER PUBLICATIONS

European Search Report for European Application No. 21214779.7 dated May 6, 2022.

*Primary Examiner* — Peter G Leigh

(74) *Attorney, Agent, or Firm* — Carlson, Gaskey & Olds, P.C.

(57) ABSTRACT

A cable assembly includes coaxially arranged inner and outer barrels. The outer barrel overlaps a portion of the inner barrel. The cable assembly further includes a cable that has at least one wire surrounded by an inner insulator that is covered in a metallic shield. The metallic shield is arranged in between the inner and outer barrels. The inner barrel includes a retention feature that is arranged beneath the metallic shield. The retention feature protrudes radially outward from the inner barrel to an outermost diameter. The outer barrel includes a crimped portion that is arranged adjacent to the retention feature and has an innermost diameter that is less than the outermost diameter to capture the metallic shield therebetween and prevent the outer barrel from axial movement relative to the inner barrel.

19 Claims, 3 Drawing Sheets

(56) References Cited

U.S. PATENT DOCUMENTS

| | | | | |
|---|---|---|---|---|
| 10,069,291 | B2 * | 9/2018 | Kitagawa | H05K 9/0081 |
| 10,594,057 | B2 * | 3/2020 | Kanemura | H01R 4/20 |
| 2004/0203286 | A1 | 10/2004 | Kameyama | |
| 2009/0098769 | A1 * | 4/2009 | Sakamoto | H01R 9/0518 439/578 |
| 2019/0356061 | A1 * | 11/2019 | Masuda | H01R 4/20 |
| 2019/0356101 | A1 * | 11/2019 | Masuda | H01R 4/183 |
| 2020/0274263 | A1 * | 8/2020 | Hashimoto | H01R 9/0518 |

* cited by examiner

BARREL CRIMP RETENTION FEATURE FOR CONNECTOR WITH BRAIDED WIRE

FIELD OF INVENTION

The disclosure relates to a barrel crimp retention feature for a connector used with a shield, such as braided wire.

BACKGROUND

Cables such as those used in high voltage applications or coaxial cables for video typically include a braided shield to prevent interference. Customer demands to meet stringent automotive-grade cable retention requirements is challenging with typical stamped and formed shielded crimp wing designs. That is, the electrical connector may pull away from the shield under design loads. Current cable designs include formed crimped wing geometries that depend upon sustainable compression forces to provide consistent friction forces throughout cable usage. New customer space constraints demand cable designs with thinner materials, making cable design even more challenging.

SUMMARY

In one exemplary embodiment, a cable assembly includes coaxially arranged inner and outer barrels. The outer barrel overlaps a portion of the inner barrel. The cable assembly further includes a cable that has at least one wire surrounded by an inner insulator that is covered in a metallic shield. The metallic shield is arranged in between the inner and outer barrels. The inner barrel includes a retention feature that is arranged beneath the metallic shield. The retention feature protrudes radially outward from the inner barrel to an outermost diameter. The outer barrel includes a crimped portion that is arranged adjacent to the retention feature and has an innermost diameter that is less than the outermost diameter to capture the metallic shield therebetween and prevent the outer barrel from axial movement relative to the inner barrel.

In a further embodiment of any of the above, the metallic shield is provided by a braided or foil sleeve.

In a further embodiment of any of the above, the inner barrel is secured to an electrical connector that has an outer housing. The metallic shield is grounded and secured to the outer housing.

In a further embodiment of any of the above, the metallic shield is covered in a nonconductive sheathing. The outer barrel is secured over the nonconductive sheathing.

In a further embodiment of any of the above, the inner and outer barrels are each metallic cylindrically-shaped or oval shaped members.

In a further embodiment of any of the above, the retention feature is provided by a flange at a terminal end of the inner barrel that is flared radially outward.

In a further embodiment of any of the above, the outer barrel has a window and the retention feature is arranged within the window. The flange is provided about a circumference of the terminal end. The flange is axially aligned with the window.

In a further embodiment of any of the above, the outer barrel has a window and the retention feature is arranged within the window. The retention feature is provided by a protrusion in the inner barrel that is arranged axially inboard of a terminal end. The protrusion is axially and circumferentially aligned with the window.

In a further embodiment of any of the above, the crimped portion is a plastically deformed area of the outer barrel that generates a clamping force on the metallic shield and the inner barrel.

In another exemplary embodiment, a method of assembling a cable includes the steps of: a) inserting the cable into an outer barrel, b) inserting an end of an inner barrel underneath a metallic shield, c) positioning a retention feature on the inner barrel, the retention feature protrudes radially outward from the inner barrel, and d) crimping the outer barrel to capture the metallic shield between the inner and outer barrels and prevent relative axial movement of the inner and outer barrels.

In a further embodiment of any of the above, step d) includes crimping the outer barrel adjacent to a window in the outer barrel. The retention feature is in the window.

In a further embodiment of any of the above, the cable includes at least one wire that is surrounded by an inner insulator that is covered in the metallic shield. Step b) includes inserting the end of the inner barrel between the inner insulator and the metallic shield.

In a further embodiment of any of the above, step c) includes sliding the outer barrel axially over the inner barrel and the metallic shield.

In a further embodiment of any of the above, prior to performing step a), the method includes a step of al) forming the retention feature by bending a circumferential flange radially outward on a terminal end of an inner barrel blank.

In a further embodiment of any of the above, prior to performing step a), the method includes a step of al) forming the retention feature by deforming a protrusion axially inboard of a terminal end of an inner barrel blank.

In a further embodiment of any of the above, the retention feature is provided by a protrusion in the inner barrel that is arranged axially inboard of the terminal end. Step c) includes circumferentially aligning the protrusion with the window.

In a further embodiment of any of the above, the method includes step e) securing the inner barrel to a terminal connector that has an outer housing. The metallic shield is grounded to the outer housing.

In a further embodiment of any of the above, the cable includes a nonconductive sheathing that covers the metallic shield. The outer barrel is secured over the nonconductive sheathing.

In a further embodiment of any of the above, the method includes step f) arranging a nonconductive strain relief member over at least portions of the terminal connector, the outer barrel and the nonconductive sheathing.

In a further embodiment of any of the above, step d) includes plastically deforming a portion of the barrel to provide an innermost diameter that is less than an outermost diameter of the retention feature.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible. Like reference numbers and designations in the various drawings indicate like elements.

DETAILED DESCRIPTION

Figure 1:
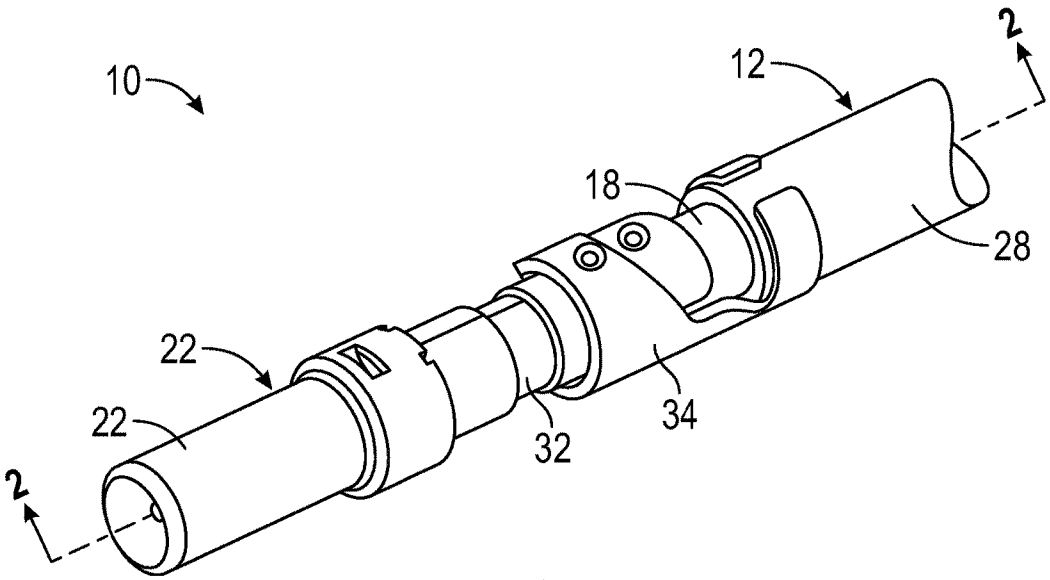
FIG. 1 is a perspective view of a portion of a coaxial cable with a connector.
Figure 2:
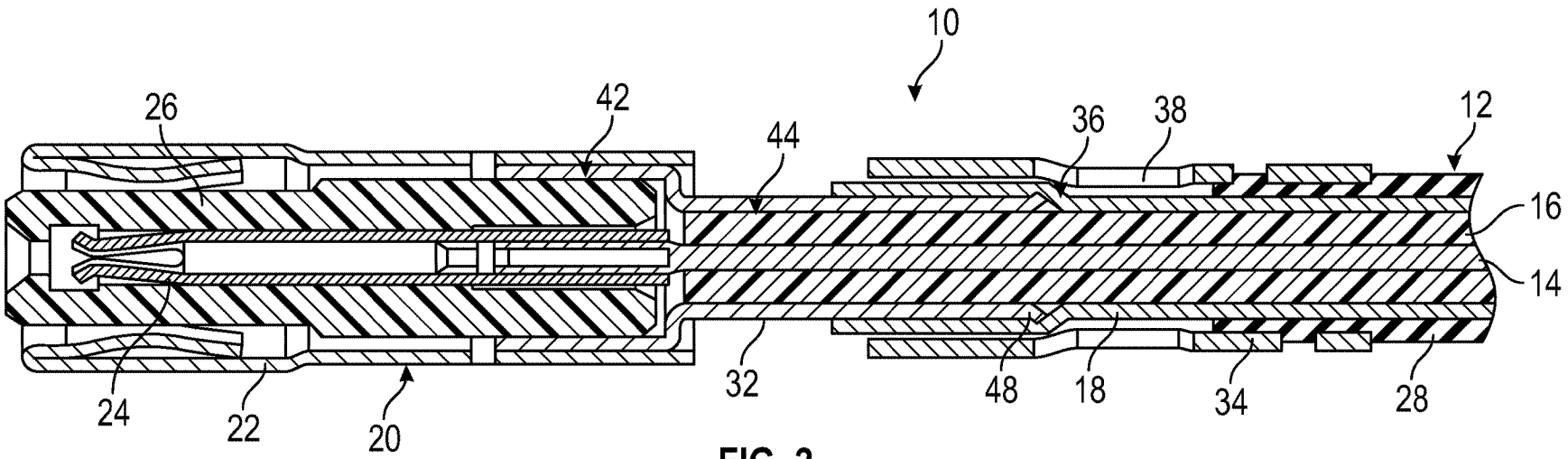
FIG. 2 is a cross-sectional view taken alone line 2-2 of FIG. 1.

A cable assembly is illustrated in FIGS. 1 and 2. The cable assembly 10 includes a coaxial cable 12 having a wire 14 surrounded by an inner insulator 16. The inner insulator is a nonconductive insulative layer. A metallic, conductive shield 18 covers the inner insulator 16. In the example, the shield 18 is a braided or foil sleeve or wire braid that provides RF interference prevention.

A connector 20 is provided at one end of the cable 12. Although the example connector 20 is illustrated as a female connector, the connector 20 may also be a male connector or a splice connector. The connector 20 includes an outer housing 22 that is grounded to the shield 18. An inner nonconductive housing 26 supports an electrical terminal 24 electrically connected to the wire 14. A nonconductive sheathing 28, such as a polymer material, is arranged over the shield 18.

Referring to FIG. 2, inner and outer barrels 32, 34 are arranged coaxially with respect to one another and in at least partially axially overlapping relationship. In the example, the inner barrel 32 includes a retention feature 36 arranged with respect to a window 38 in the outer barrel 34. The retention feature 36 cooperates with the window 38 when fully assembled to provide a stop that prevents slippage or axial movement of the inner and outer barrels 32, 34 with respect to one another in order to capture the shield 18 throughout a designed for pullout forces. Standard crimping operations may be used, and degradation of the connection between the connector 20 and the cable 12 is avoided during use of the cable assembly 10.

Figure 3A:
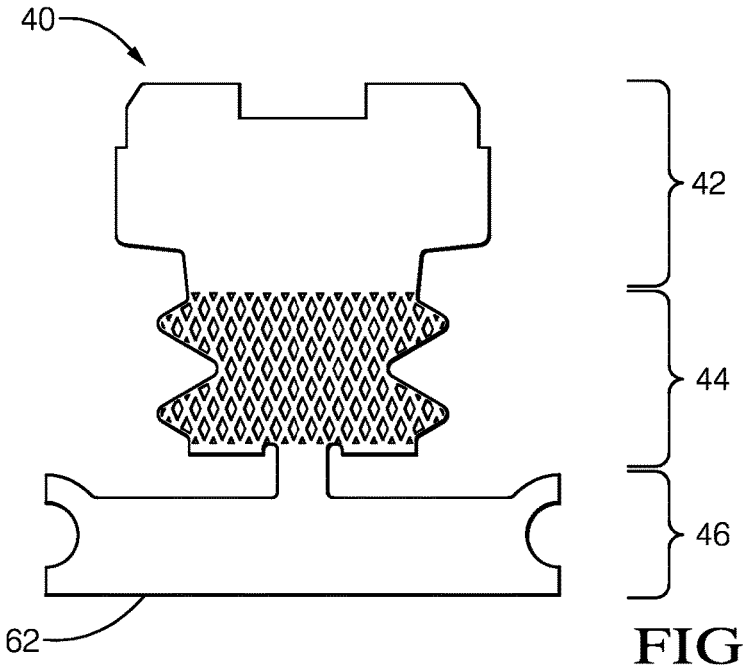
FIG. 3A is a top view of an inner barrel blank.
Figure 3B:
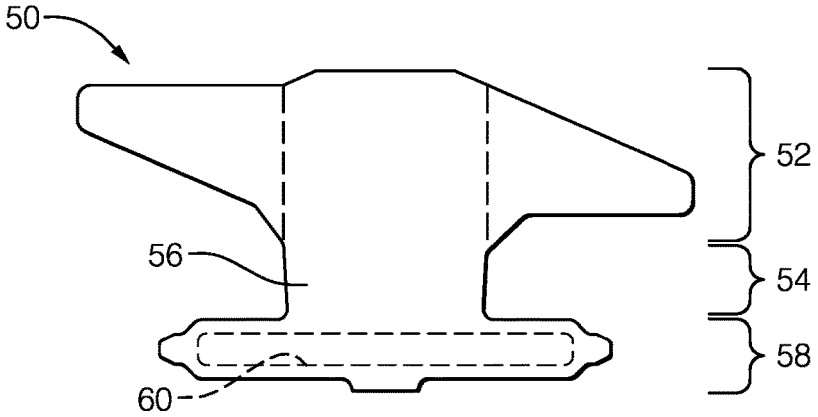
FIG. 3B is a top view of an outer barrel blank.

The inner and outer barrel blanks 40, 50 are respectively shown in FIGS. 3A and 3B. Referring to the inner barrel blank 40, a flat metal stamping is rolled into a cylindrical or oval shape to provide first and second diameter portions 42, 44; the first diameter portion 42 is larger than the second diameter portion 44 in the illustrated example. In one example embodiment, the second diameter portion 44 provides an end 62. The terminal end 62 provides the flange 48 that is flared radially outwardly with respect to the second diameter portion 44. When fully assembled, the first diameter portion 42 is joined to the outer housing 22.

Referring to the outer barrel blank 50, a main body portion 52 is provided as a cylindrical or oval shape. The main body portion 52 is adjoined to a winged portion 58 by a longitudinal portion 56 which is arcuate in shape. The longitudinal portion is narrower than the main body portion 52 and the winged portion 58 such that a window portion 54 is provided that forms the window 38, best shown in FIGS. 2 and 4A. A reinforcing indentation or depression 60 may be provided in the winged portion 58 to provide further rigidity. The winged portion 58 is secured over the sheathing 28 by a crimp, for example.

Figure 4A:
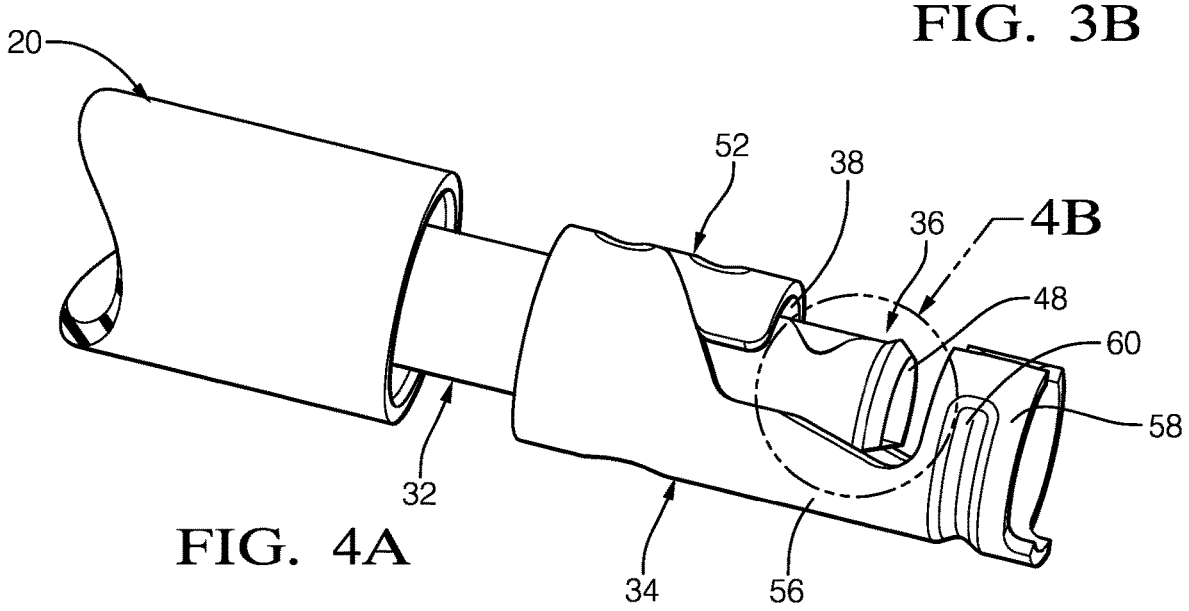
FIG. 4A is a perspective view of the inner and outer barrels arranged coaxially relative to one another with the cable omitted for clarity.
Figure 4B:
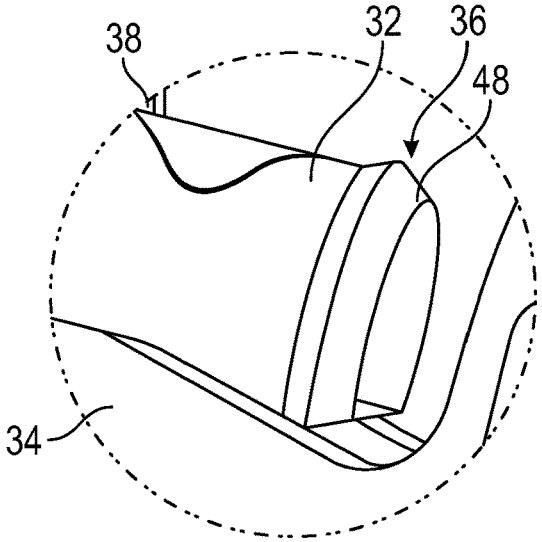
FIG. 4B is an enlarged view of a portion of the inner and outer barrels, illustrating a flange on the inner barrel providing a braid retention feature.
Figure 5:
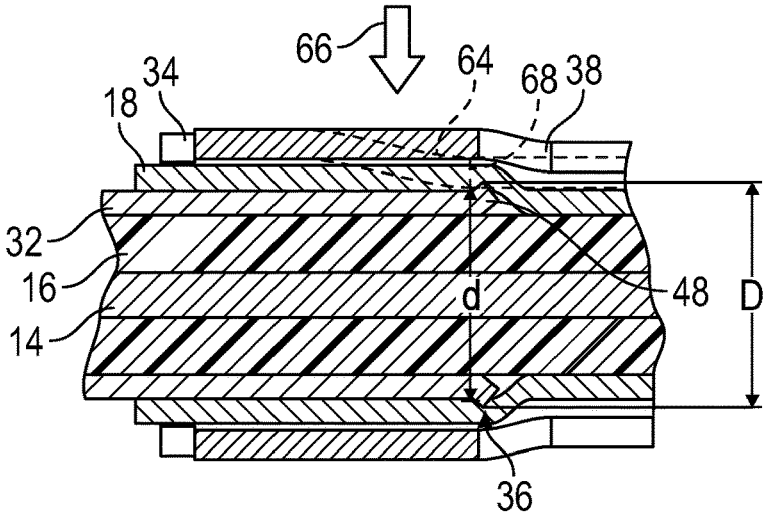
FIG. 5 is an enlarged cross-sectional view of a portion of the inner and outer barrels with a metallic shield retained therebetween.

Referring to FIGS. 4A-5, the retention feature 36 is arranged within the window 38. During assembly, a portion of the outer barrel 34 is plastically deformed by a crimping force 66, as shown in FIG. 5, to provide a crimped portion 64 adjacent to the flange 48. The crimped portion 64 provides an edge 68 that has an innermost diameter d that is smaller than an outermost diameter D of the flange 48. In this manner, the shield 18 is securely retained between the edge 68 and the flange 48 preventing pullout of the shield 18 under axial loads.

Figure 6:
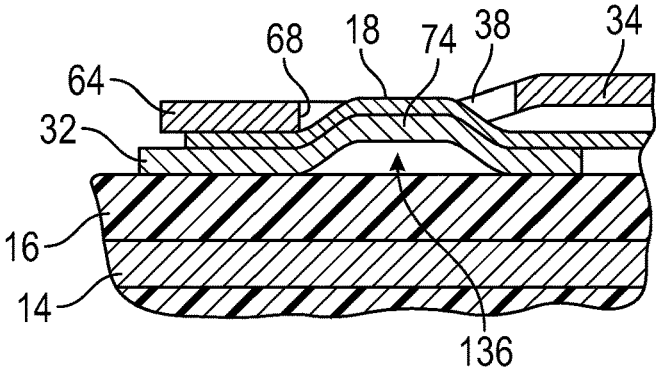
FIG. 6 depicts another example braid retention feature.

Another example configuration is illustrated in FIG. 6. In this example, the retention feature 136 is provided by a protrusion 74 in the inner barrel 32. The edge 68 of the crimped portion 64 is adjacent to the protrusion 74 such that the protrusion 74 and the supported shield 18 cannot be pulled axially out of the window 38 in the outer barrel 34.

In operation, the cable assembly 10 is assembled by inserting the cable 12 into the outer barrel 34. An end of the inner barrel 32 is arranged underneath the shield 18. Because the retention feature 36 extends radially outward, the ease of insertion of the inner barrel 32 between the shield 18 and the inner insulator 16 is improved. The retention feature 36 is positioned within the window 38. The outer barrel 34 is crimped adjacent to the window 38 to capture the shield 18 between the inner and outer barrels 32, 34 and prevent relative axial movement of the inner and outer barrels 32, 34, thus, securely retaining the shield 18.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A cable assembly comprising:

coaxially arranged inner and outer barrels, the outer barrel overlaps a portion of the inner barrel, the outer barrel has a window;

a cable including at least one wire surrounded by an inner insulator covered in a metallic shield, wherein the metallic shield is arranged in between the inner and outer barrels; and wherein the inner barrel includes a retention feature arranged beneath the metallic shield and within the window, the retention feature protruding radially outward from the inner barrel to an outermost diameter, and the outer barrel includes a crimped portion arranged adjacent to the retention feature and having an innermost diameter that is less than the outermost diameter to capture the metallic shield therebetween and prevent the outer barrel from axial movement relative to the inner barrel.

2. The cable assembly of claim 1, wherein the metallic shield is provided by a braided or foil sleeve.

3. The cable assembly of claim 1, wherein the inner barrel is secured to an electrical connector having an outer housing, and the metallic shield is grounded and secured to the outer housing.

4. The cable assembly of claim 3, wherein the metallic shield is covered in a nonconductive sheathing, and the outer barrel is secured over the nonconductive sheathing.

5. The cable assembly of claim 1, wherein the inner and outer barrels are each metallic cylindrically-shaped or oval shaped members.

6. The cable assembly of claim 5, wherein the retention feature is provided by a flange at a terminal end of the inner barrel that is flared radially outward.

7. The cable assembly of claim 6, wherein the flange is provided about a circumference of the terminal end, the flange is axially aligned with the window.

8. The cable assembly of claim 5, wherein the retention feature is provided by a protrusion in the inner barrel that is arranged axially inboard of a terminal end, the protrusion is axially and circumferentially aligned with the window.

9. The cable assembly of claim 1, wherein the crimped portion is a plastically deformed area of the outer barrel that generates a clamping force on the metallic shield and the inner barrel.

10. A method of assembling a cable comprising the steps of:

a) inserting the cable into an outer barrel;

b) inserting an end of an inner barrel underneath a metallic shield;

c) positioning a retention feature on the inner barrel, wherein the retention feature protrudes radially outward from the inner barrel; and d) crimping the outer barrel adjacent to a window in the outer barrel to capture the metallic shield between the inner and outer barrels with the retention feature in the window and prevent relative axial movement of the inner and outer barrels.

11. The method of claim 10, wherein the cable includes at least one wire surrounded by an inner insulator covered in the metallic shield, and step b) includes inserting the end of the inner barrel between the inner insulator and the metallic shield.

12. The method of claim 10, wherein step c) includes sliding the outer barrel axially over the inner barrel and the metallic shield.

13. The method of claim 10, wherein prior to performing step a), comprising a step of al) forming the retention feature by bending a circumferential flange radially outward on a terminal end of an inner barrel blank.

14. The method of claim 10, wherein prior to performing step a), comprising a step of al) forming the retention feature by deforming a protrusion axially inboard of a terminal end of an inner barrel blank.

15. The method of claim 14, wherein the retention feature is provided by a protrusion in the inner barrel that is arranged axially inboard of the terminal end and wherein step c) includes circumferentially aligning the protrusion with the window.

16. The method of claim 10, comprising step e) securing the inner barrel to a terminal connector having an outer housing, and the metallic shield is grounded to the outer housing.

17. The method of claim 16, wherein the cable includes a nonconductive sheathing covering the metallic shield, and the outer barrel is secured over the nonconductive sheathing.

18. The method of claim 17, comprising step f) arranging a nonconductive strain relief member over at least portions of the terminal connector, the outer barrel and the nonconductive sheathing.

19. The method of claim 10, wherein step d) includes plastically deforming a portion of the barrel to provide an innermost diameter that is less than an outermost diameter of the retention feature.

* * * * *